US007399058B2

(12) United States Patent
Ikegame

(10) Patent No.: US 7,399,058 B2
(45) Date of Patent: Jul. 15, 2008

(54) LIQUID JET HEAD

(75) Inventor: Tetsuo Ikegame, Hachioji (JP)

(73) Assignee: Olympus Corporation, Tokyo (JP)

( * ) Notice: Subject to any disclaimer, the term of this patent is extended or adjusted under 35 U.S.C. 154(b) by 139 days.

(21) Appl. No.: 11/196,149

(22) Filed: Aug. 3, 2005

(65) Prior Publication Data

US 2006/0028505 A1 Feb. 9, 2006

(30) Foreign Application Priority Data

Aug. 9, 2004 (JP) ..... 2004-232450

(51) Int. Cl.
*B41J 2/145* (2006.01)

(52) U.S. Cl. ..... 347/41; 347/17; 347/20; 347/37; 347/40; 347/43

(58) Field of Classification Search ..... 347/17, 347/20, 37, 40–43
See application file for complete search history.

(56) References Cited

U.S. PATENT DOCUMENTS 5,771,052 A * 6/1998 Hine et al. ..... 347/42
6,254,218 B1 * 7/2001 Suzuki et al. ..... 347/43
6,443,554 B1 * 9/2002 Yoshida ..... 347/41
2002/0008731 A1 * 1/2002 Matsumoto et al. ..... 347/42
2002/0033861 A1 * 3/2002 Boyd et al. ..... 347/42
2002/0075343 A1 * 6/2002 Classens et al. ..... 347/17
2004/0075713 A1 * 4/2004 Takano et al. ..... 347/37
2004/0165026 A1 * 8/2004 Ikemoto et al. ..... 347/20
2004/0201643 A1 * 10/2004 Kuwahara ..... 347/42

FOREIGN PATENT DOCUMENTS

JP 2003-1855 A 1/2003
JP 2003-320652 A 11/2003

* cited by examiner

*Primary Examiner*—Matthew Luu
*Assistant Examiner*—Joshua M Dubnow
(74) *Attorney, Agent, or Firm*—Frishauf, Holtz, Goodman & Chick, P.C.

(57) ABSTRACT

End portions on one side of respective heads in a head unit are inserted and arranged in respective spaces between end portions on the other side of respective heads in an adjoining head unit.

13 Claims, 11 Drawing Sheets

LIQUID JET HEAD

CROSS-REFERENCE TO RELATED APPLICATIONS

This application is based upon and claims the benefit of priority from prior Japanese Patent Application No. 2004-232450, filed Aug. 9, 2004, the entire contents of which are incorporated herein by reference.

BACKGROUND OF THE INVENTION

1. Field of the Invention

The present invention relates to a printer such as an inkjet printer, a copying machine or a facsimile which ejects liquid droplets of ink or the like with respect to, e.g., a recording medium to perform printing, a micro-eject apparatus for an adhesive, a manufacturing apparatus of a color filter in a liquid crystal display, or the like, and more particularly, it relates to a liquid jet head which is used for ejecting a small amount of liquid droplets of, e.g., ink.

2. Description of the Related Art

For example, an inkjet printer uses a liquid jet head to eject ink from nozzles of a head. This liquid jet head utilizes many heads for high-speed printing onto a recording medium, realization of multicolor printing and other effects. Each of these heads has a nozzle array in which a plurality of nozzles are arranged. As a result, many nozzle arrays are arranged.

For example, Jpn. Pat. Appln. KOKAI Publication No. 2003-320652 relates to a building plate printer, and discloses that this printer comprises a plurality of print heads 1-1 to 1-n and 2-1 to 2-n-1 as shown in FIG. 16. In each of the print heads 1-1 to 1-n and 2-1 to 2-n-1, there are integrally disposed a nozzle array K which ejects black ink, a nozzle array C which ejects cyan ink, a nozzle array M which ejects magenta ink and a nozzle array Y which ejects yellow ink. As a result, each of the print heads 1-1 to 1-n and 2-1 to 2-n-1 has a four-string nozzle array KCMY. Each nozzle array K, C, M or Y has a nozzle array length a. In each of the nozzle arrays K, C, M and Y, a plurality of inkjet nozzles are arranged in a string in a main scanning direction (a Y direction) at a predetermined pitch and in a sub-scanning direction (an X direction) at predetermined intervals b.

The respective print heads 1-1 to 1-n and the respective print heads 2-1 to 2-n-1 are alternately arranged in a zigzag pattern with respect to the main scanning direction (the Y direction) orthogonal to a building plate carrying direction (the X direction). As a result, the respective print heads 1-1 to 1-n and the respective print heads 2-1 to 2-n-1 are arranged in two parallel strings along the building plate carrying direction (the X direction). Therefore, the length of the entire print head with respect to the sub-scanning direction (the X direction) requires a value corresponding to two print heads, e.g., lengths of the print head 1-1 and the print head 2-1.

Jpn. Pat. Appln. KOKAI Publication No. 2003-1855 discloses such an inkjet printer incorporating a recovery device as shown in FIG. 17. This inkjet printer mainly comprises a paper carriage device (not shown) and a head device 4. The head device 4 has 24 liquid jet heads 3A1 to 3D6 each having a nozzle array which ejects ink. The head device 4 comprises four-color head blocks, i.e., a B (black) head block 3A, a C (cyan) head block 3B, an M (magenta) head block 3C and a Y (yellow) head block 3D. For example, the B head block 3A is detachably attached to attachment opening portions 5Al, 5A4 and the like of a head substrate 5A, and comprises six liquid jet heads $3A_1$ to $3A_6$ which downwardly eject ink. The respective liquid jet heads $3A_1$ to $3A_3$ and the respective liquid jet heads $3A_4$ to $3A_6$ are arranged in multiple strings along an inclined line La which is inclined with respect to the X direction or a line parallel to this inclined line La in a full-width region of a recording medium. The C head block 3B, the M head block 3C and the Y head block 3D also have the same configuration.

BRIEF SUMMARY OF THE INVENTION

There is provided a liquid jet head according to a main aspect of the present invention comprising a plurality of heads each having a nozzle array in which a plurality of nozzles to eject at least liquid droplets are arranged in a line state, wherein the respective heads form at least two head arrays in parallel at predetermined intervals in a second direction substantially orthogonal to a first direction is an arrangement direction of the nozzle array, and end portions on one side of the respective heads in one of the adjoining head arrays are inserted and arranged in respective spaces between end portions on the other side of the respective heads in the other head array.

DETAILED DESCRIPTION OF THE INVENTION

A first embodiment according to the present invention will now be described hereinafter with reference to the accompanying drawings.

Figure 1:
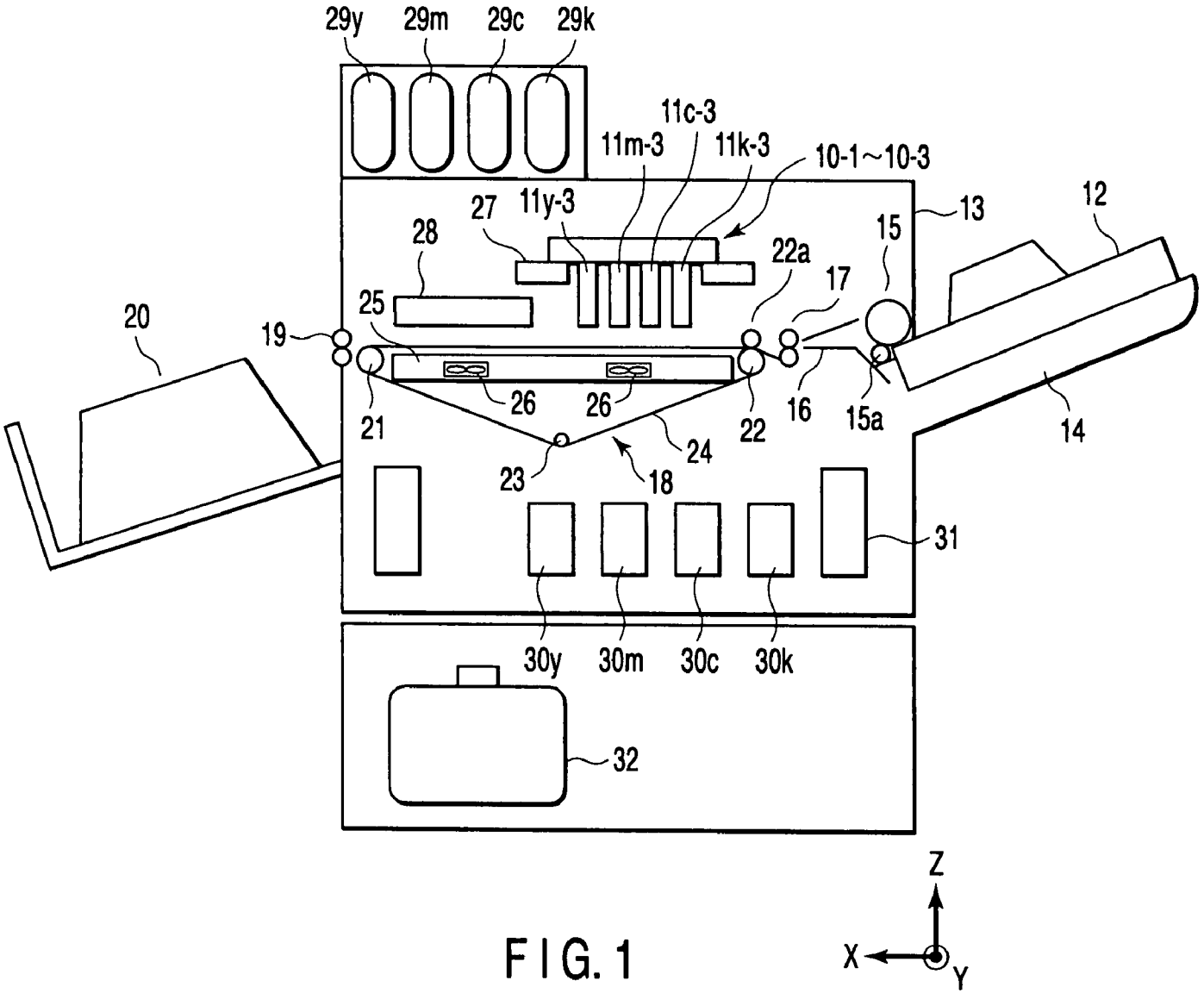
FIG. 1 is a block diagram showing a first embodiment of an image forming apparatus to which a liquid jet head according to the present invention is applied.

FIG. 1 is a block diagram showing an image forming apparatus to which a liquid jet head is applied. This image forming apparatus adopts an inkjet mode. In this image forming apparatus adopting the inkjet mode, the direction orthogonal to the carriage direction (the X-axis direction) of a recording medium 12 is determined as the Y-axis direction (the main scanning direction) and the carriage direction of the recording medium 12 is determined as the X-axis direction.

The image forming apparatus has respective head units 10-1 to 10-3 holding respective heads 11*k*-1, 11*c*-1, . . . , 11*y*-3. The image forming apparatus ejects respective inks of, e.g., black (which will be referred to as a K color hereinafter), cyan (which will be referred to as a C color hereinafter), magenta (which will be referred to as an M color hereinafter) and yellow (which will be referred to as a Y color hereinafter) from the respective heads 11*k*-1, 11*c*-1, . . . , 11*y*-3 in the respective head units 10-1 to 10-3. Further, the image forming apparatus carries the recording medium 12 such as a paper sheet below the respective heads 11*k*-1, 11*c*-1, . . . , 11*y*-3. As a result, the respective inks having the K color, the C color, the M color and the Y color are spotted onto the recording medium 12. Consequently, a color image is formed on the recording medium 12.

The image forming apparatus roughly has a medium supply/ejection mechanism, a carriage mechanism, an image formation mechanism, an ink supply/accommodation mechanism, and a maintenance mechanism. The medium supply/ejection mechanism performs supply and ejection of the recording medium 12. The carriage mechanism carries the recording medium 12. The image formation mechanism ejects the respective inks of the K color, the C color, the M color and the Y color onto the recording medium 12 carried by the carriage mechanism, thereby forming an image. The ink supply/accommodation mechanism performs supply and accommodation of the respective inks of the K color, the C color, the M color and the Y color. The maintenance mechanism carries out maintenance of the respective heads 11*k*-1, 11*c*-1, . . . , 11*y*-3.

The medium supply/ejection mechanism will now be described. A recording medium supply base 14 is attached to a supply side of an apparatus main body frame 13. The plurality of recording mediums 12 are loaded in the recording medium supply base 14.

A paper feed roller 15 is provided in the apparatus main body frame 13. The paper feed roller 15 comes into contact with one recording medium 12 loaded at an uppermost position of the recording mediums 12 loaded in the recording medium supply base 14, and rotates to feed the recording medium 12 into the apparatus main body frame 13.

A separation roller 15*a* comes into surface-contact with the paper feed roller 15 and is provided parallel to the paper feed roller 15. The paper feed roller 15 is in surface-contact with a rear side of the surface of the recording medium 12 which is in contact with the separation roller 15*a*. The paper feed roller 15 rotates in a direction of returning the recording medium 12 toward the recording medium supply base 14 side through, e.g., a torque limiter. As a result, the separation roller 15*a* does not take out, e.g., the two or more recording mediums 12 in a superposed state from the recording medium supply base 14.

A paper feed guide 16 and a resist roller pair 17 are provided in a paper feed direction of the recording medium 12 taken out by the separation roller 15*a*. The resist roller pair 17 utilizes looseness of the recording medium 12 produced by contact of an end of the recording medium 12 to feed the recording medium 12 toward a belt platen unit 18 which is the carriage mechanism while correcting obliqueness.

A paper ejection roller pair 19 is provided on an ejection side of the apparatus main body frame 13. The paper ejection roller pair 19 ejects the recording medium 12 having an image formed thereon which is carried from the belt platen unit 18 to the outside of the apparatus main body frame 13. A paper ejection tray 20 is externally attached to the apparatus main body frame 13 on the ejection side. The recording medium 12 ejected to the outside of the apparatus main body frame 13 is accommodated in the paper ejection tray 20.

The carriage mechanism mainly has the belt platen unit 18 and a platen elevation mechanism. The belt platen unit 18 has a driving roller 21 provided on the downstream side in the carriage direction (the X-axis direction) of the recording medium 12, a driven roller 22 provided on the upstream side, and a tension roller 23. The tension roller 23 is provided between the driving roller 21 and the driven roller 22 and below the driving roller 21 and the driven roller 22. An endless belt 24 is wound around the driving roller 21, the driven roller 22 and the tension roller 23. Many suction holes are provided to the belt 24. The belt 24 undergoes tension by the tension roller 23. The belt 24 swivels around the driving roller 21, the driven roller 22 and the tension roller 23 by driving of the driving roller 21. An auxiliary roller 22*a* is in contact with the driven roller 22.

A suction chamber 25 is provided below the belt 24 which moves between the driving roller 21 and the driven roller 22. A plurality of suction fans 26 are attached on a bottom portion in the suction chamber 25. Each suction fan 26 forms a negative pressure in the suction chamber 25. The driving roller 21, the driven roller 22, the tension roller 23 and the suction chamber 25 constituting the belt platen unit 18 are provided in the apparatus main body frame 13.

Therefore, the belt platen unit 18 vacuums up air through each suction hole of the belt 24 by driving of each suction fan 26 in the suction chamber 25 to suck the recording medium 12 on the belt 24, and carries the recording medium 12 in the X-axis direction (the sub-scanning direction) at a predetermined speed by swiveling of the belt 24. The platen elevation mechanism moves up and down the belt platen unit 18 in a Z-axis direction (an up-and-down direction).

The image formation mechanism has, e.g., the three heads 10-1 to 10-3 and a carriage 27. The respective heads 11*k*-1, 11*c*-1, . . . , 11*y*-3 are mounted on the respective head units 10-1 to 10-3. The head units 10-1 to 10-3 are attached to the carriage 27. The respective heads 11*k*-1, 11*c*-1, . . . , 11*y*-3 are arranged to face a carriage surface of the belt 24 of the belt platen unit 18. The respective heads 11*k*-1, 11*c*-1, . . . , 11*y*-3 have the same configuration and have the respective inks of different colors (KCMY) to be ejected.

The maintenance mechanism has a maintenance unit 28 provided on the downstream side in the carriage direction of the recording medium 12. Like the respective heads 11*k*-1, 11*c*-1, . . . , 11*y*-1, the maintenance unit 28 is arranged to face the carriage surface of the belt 24 in the belt platen unit 18. The maintenance unit 28 is provided in the apparatus main body frame 13.

The ink supply/accommodation mechanism mainly has a plurality of bottles 29*k*, 29*c*, 29*m* and 29*y*, respective sub-tanks 30*k*, 30*c*, 30*m* and 30*y*, a suction pump 31 and a waste liquid bottle 32. The respective inks of the K color, the C color, the M color and the Y color are filled in the respective bottles 29*k*, 29*c*, 29*m* and 29*y*. The respective sub-tanks 30, 30*c*, 30*m* and 30*y* supply the respective inks of the K color, the C color, the M color and the Y color from the respective bottles 29*k*, 29*c*, 29*m* and 29*y* to the respective heads 11*k*-1, 11*c*-1, . . . , 11*y*-3. The suction pump 31 sucks unnecessary inks. The waste liquid bottle 32 collects and accommodates the inks which are no longer necessary.

The respective bottles 29*k*, 29*c*, 29*m* and 29*y* are provided at uppermost positions in ink flow paths through which the respective inks of the K color, the C color, the M color and the Y color flow above the apparatus main body frame 13. The respective bottles 29*k*, 29*c*, 29*m* and 29*y* communicate with the respective sub-tanks 30*k*, 30*c*, 30*m* and 30*y* through supply paths. The respective inks of the K color, the C color, the M color and the Y color which have overflowed from the respective sub-tanks 30*k*, 30*c*, 30*m* and 30*y* are accommodated in the waste liquid bottle 32 by the suction pump 31.

A concrete configuration of the respective heads 11*k*-1, 11*c*-1, . . . , 11*y*-1 will now be described with reference to FIGS. 3 to 7. As the respective heads 11*k*-1, 11*c*-1, . . . , 11*y*-3, an inkjet printer head which is of a share mode type in which an ink chamber is formed by using a piezoelectric member is used. The respective heads 11*k*-1, 11*c*-1, . . . , 11*y*-3 may adopt any other mode such as a bubble jet mode or a configuration using an MEMS.

The respective heads 11*k*-1, 11*c*-1, . . . , 11*y*-3 have the same configuration. Here, a configuration of, e.g., one head 11*k*-1 will be described, and an explanation of the other heads 11*c*-1, . . . , 11*y*-3 will be eliminated.

Figure 3:
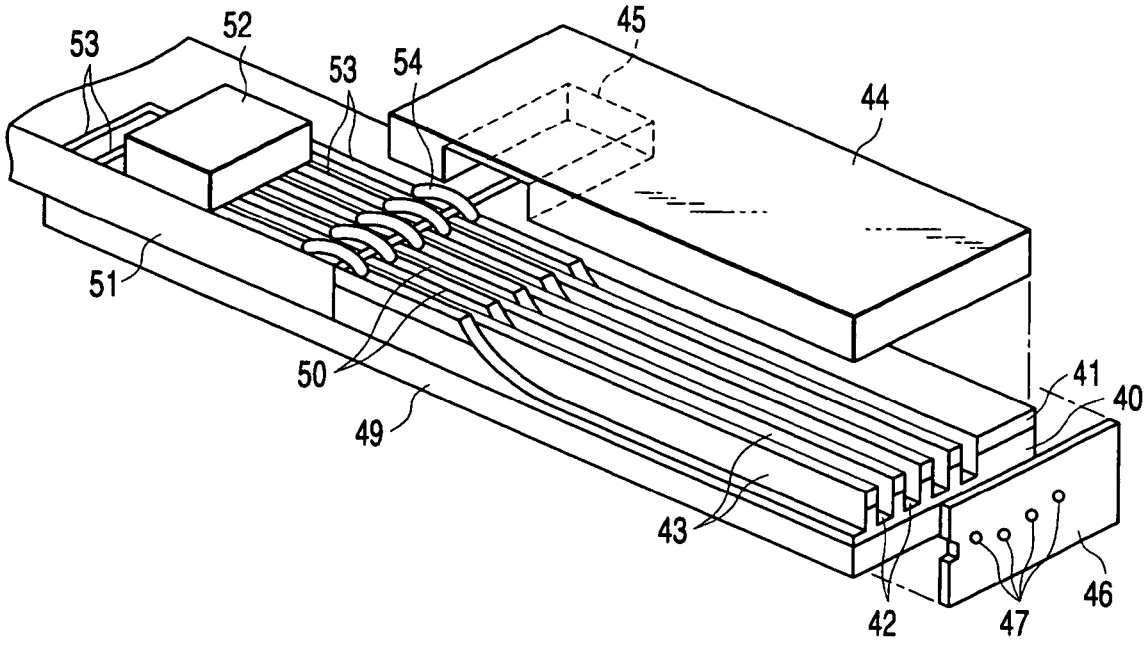
FIG. 3 is a block diagram showing the head in the same head unit.
Figure 4:
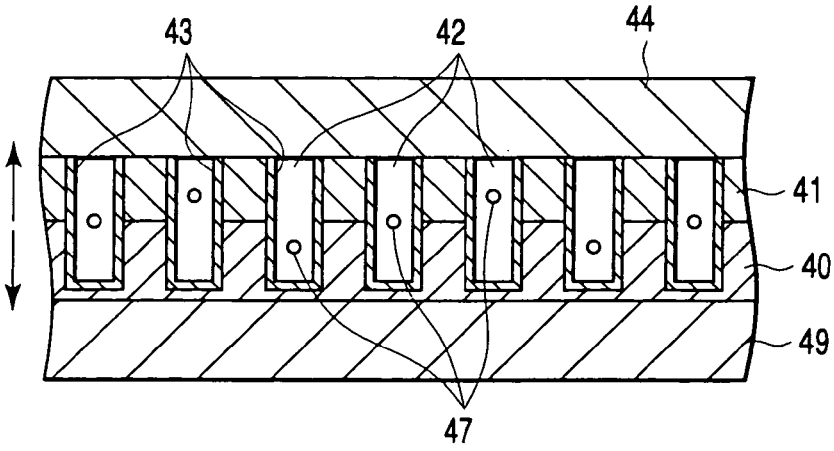
FIG. 4 is a block diagram showing the head in the same head unit.

In the head 11*k*-1, two piezoelectric members 40 and 41 are attached to each other as shown in FIGS. 3 and 4. The two piezoelectric members 40 and 41 are polarized in directions opposite to their facing directions along a board thickness direction. The respective piezoelectric members 40 and 41 are attached in such a manner that one piezoelectric member 40 is provided on the lower side and the other piezoelectric member 41 is provided on the upper side, for example. A plurality of long grooves 42 are formed on the respective attached piezoelectric members 40 and 41 at fixed intervals in parallel. Each groove 42 is opened on the upper side with respect to the piezoelectric members 40 and 41. Each groove 42 is formed to have a groove bottom which is deep at the front end portion and becomes gradually shallow toward the rear end portion.

Figure 5:
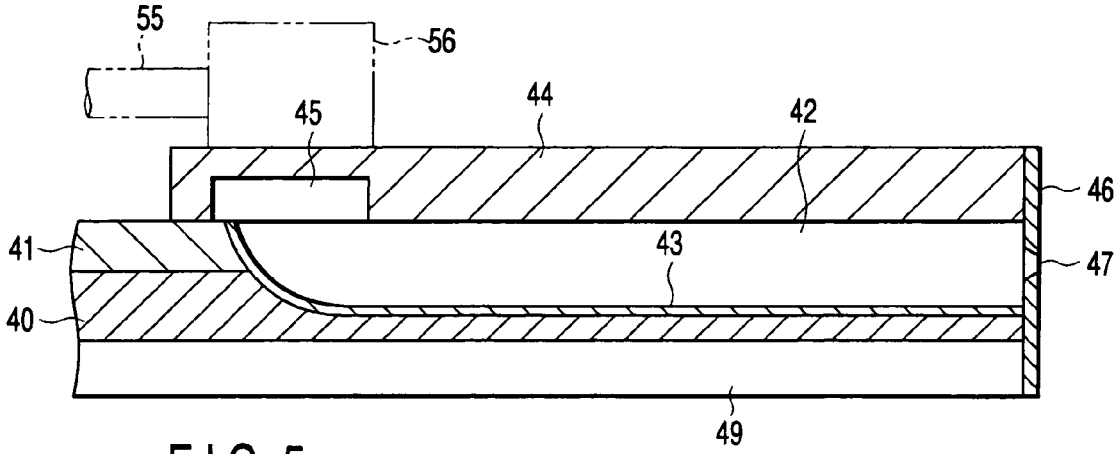
FIG. 5 is a block diagram showing the head in the same head unit.

As shown in FIGS. 3 and 5, respective electrodes 43 are formed on side walls and the bottom surface of each groove 42. Each electrode 43 is formed by electroless deposition. The upper portion of each groove 42 is closed by a top panel 44. A common ink chamber 45 is formed on an inner side of the top panel 44. The front end of each groove 42 is closed by a nozzle plate 46. Each nozzle array 47 in which a plurality of nozzles are provided in a line state is formed at each position in the nozzle plate 46 corresponding to each groove 42.

Figure 6:
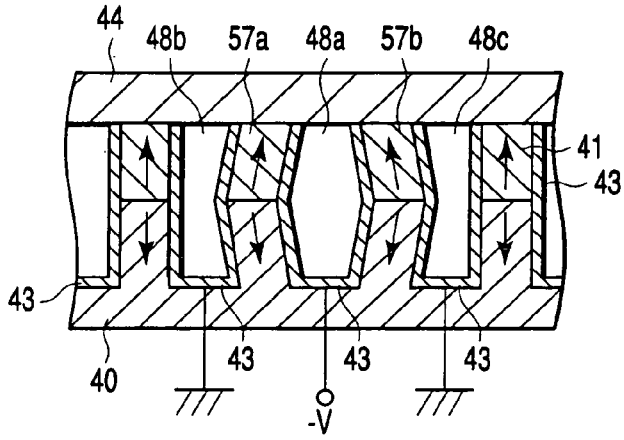
FIG. 6 is a block diagram showing the head in the same head unit.

For example, as shown in FIG. 6, respective ink chambers 48*a*, 48*b* and 48*c* are formed of the respective grooves 42 surrounded by the top panel 44 and the nozzle plate 46. The top panel 44, the nozzle plate 46 and the respective ink chambers 48*a*, 48*b* and 48*c* are bonded and fixed to a substrate 49.

As shown in FIG. 3, extraction electrodes 50 are provided. The extraction electrodes 50 are extended from the electrodes 43 to be formed from the rear ends of the respective grooves 42 onto the rear upper surface of the piezoelectric member 41. The extraction electrodes 50 are formed by electroless deposition.

A print circuit board (a PC board) 51 is bonded and fixed on the rear side on the substrate 49. A drive IC 52 having a built-in head driving portion is mounted on the PC board 51. Respective electroconductive patterns 53 are connected with the drive IC 52. A terminal portion 51*a* is provided to the PC board 51. Each electroconductive pattern and each extraction electrode 50 are coupled with each other through a conductive wire 54 by wire bonding. Each ink of the K color, the C color, the M color or the Y color is supplied into the common ink chamber 45 through a tube fixing member 56 fixed to the top panel 44 from a tube 55.

A driving principle of the head 11*k*-1 will now be described. As shown in FIG. 6, the respective electrodes 43 of the respective ink chambers 48*b* and 48*c* are set to a ground potential. In this state, when a voltage −V is applied to, e.g., the ink chamber 48*a* for a time $T_1$, electric fields are generated to respective side walls 57*a* and 57*b* of the ink chamber 48*a* in directions orthogonal to the polarization directions of the respective piezoelectric members 40 and 41. As a result, the respective side walls 57*a* and 57*b* are outwardly deformed. The capacity of the ink chamber 48*a* is increased. A pressure in the ink chamber 48 is reduced, and the ink of the K color, the C color, the M color or the Y color is fetched from the common ink chamber 45.

Next, in a state where the respective electrodes 43 of the respective ink chambers 48*b* and 48*c* are set to a ground potential, when a voltage +V is applied to the ink chamber 48a for a time $T_2$, electric fields are generated to the respective side walls 57*a* and 57*b* in directions opposite to the directions orthogonal to the polarization directions of the respective piezoelectric members 40 and 41 and the above-described directions of the electric fields. As a result, the respective side walls 57*a* and 57*b* are inwardly deformed. The capacity of the ink chamber 48*a* is reduced. Consequently, the pressure in the ink chamber 48*a* is increased, and ink droplets of the K color, the C color, the M color or the Y color are ejected from each nozzle in the nozzle array 47 of the ink chamber 48*a*.

Figure 7:
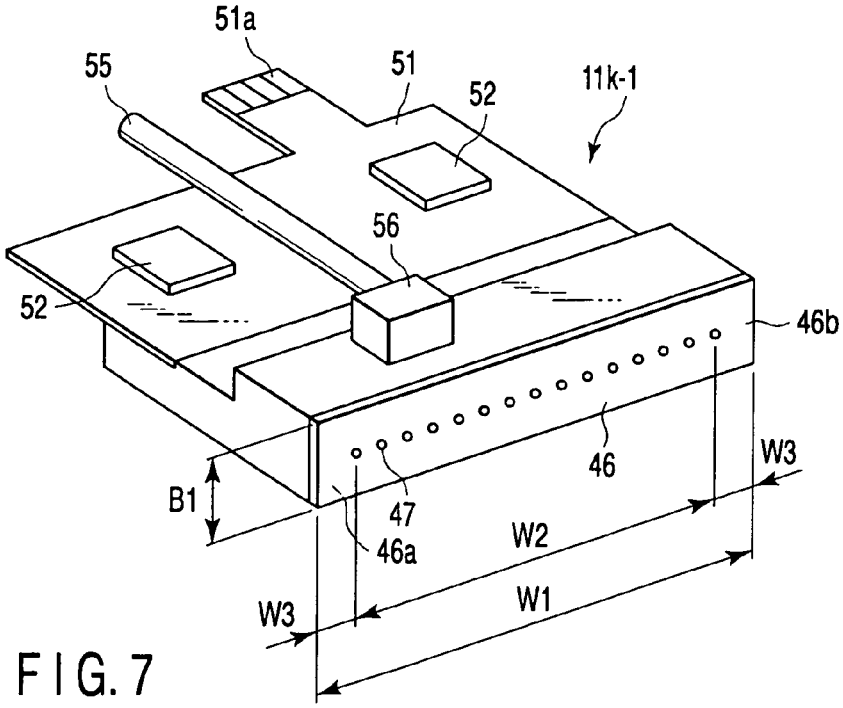
FIG. 7 is a block diagram showing the head in the same head unit.

The nozzle array 47 having the approximately 1240 nozzles is provided on the nozzle plate 46, as shown in FIG. 7. When the respective heads 11*k*-1, 11*c*-1, . . . , 1*y*-3 are attached to the image forming apparatus, the nozzle arrays 47 are arranged in a direction (the Y-axis direction) orthogonal to the carriage direction (the X-axis direction) of the recording medium 12. As to the nozzle array 47, the respective nozzles are provided in one array with a density of, e.g., 300 dpi (an interval of 84.6 μm) in the main scanning direction of the Y-axis direction. A nozzle array length $W_2$ of the nozzle array 47 in a length $W_1$ of the nozzle plate 46 in an arrangement direction (the Y-axis direction) of the nozzle array 47 is, e.g., 105 mm.

In order to provide the nozzle array 47 having such a narrow pitch to respective plate end portions on both sides of the nozzle plate 46, rigidity of the walls of the respective piezoelectric members 40 and 41 at both ends must be improved.

Due to such circumstances, respective plate end portions 46*a* and 46*b* on which no nozzle array 47 is provided are formed at the both end portions of the nozzle plate 46. The respective plate end portions 46*a* and 46*b* have a length $W_3$. The length $W_3$ of the respective plate end portions 46*a* and 46*b* is, e.g., 5 mm. The length $W_1$ of the nozzle plate 46 is, e.g., 115 mm.

Figure 8:
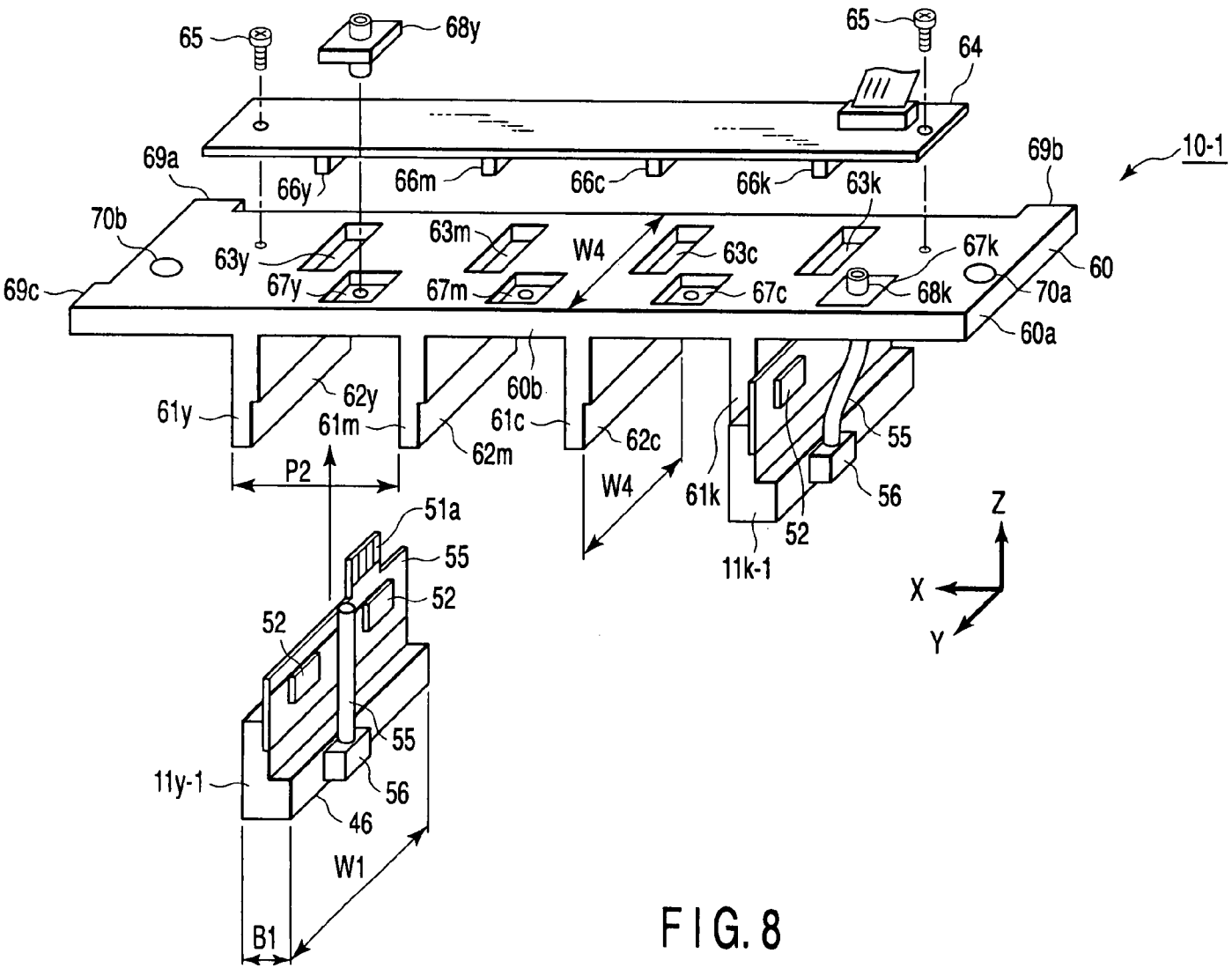
FIG. 8 is a block diagram of the same head unit.

FIG. 8 is a block diagram of the respective head units 10-1 to 10-3. The respective head units 10-1 to 10-3 have the same configuration. Here, for example, one head unit 10-1 will be described, and an explanation of the other head units 10-2 and 10-3 will be eliminated.

The head unit 10-1 has a head plate 60 as a tabular holding member formed into a strip-like shape. The head plate 60 has a short side 60*a* and a long side 60*b*. When the head plate 60 is provided in the image forming apparatus, the short side 60*a* is provided along the Y-axis direction (the main scanning direction) which is the arrangement direction of the nozzle array 47, and the long side 60*b* is provided along the X-axis direction (the sub-scanning direction) which is vertical to the arrangement direction of the nozzle array 47.

A plurality of head attachment portions 61*k*, 61*c*, 61*m* and 61*y* are provided on one surface (a lower surface) of the head plate 60. The respective head attachment portions 61*k*, 61*c*, 61*m* and 61*y* are provided at a predetermined second pitch $P_2$ in the X-axis direction along the long side 60*b*. Each of the head attachment portions 61*k*, 61*c*, 61*m* and 61*y* is formed into a downwardly protruding shape from the lower surface of the head plate 60. Respective attachment step portions 62*k*, 62*c*, 62*m* and 62*y* are provided on respective protruding lower sides of the head attachment portions 61*k*, 61*c*, 61*m* and 61*y*. The longitudinal direction of each of the head attachment portions 61*k*, 61*c*, 61*m* and 61*y* is provided along the Y-axis direction (the main scanning direction). The length of each head attachment portion 61*k*, 61*c*, 61*m* or 61*y* in the longitudinal direction is set to $W_4$ which is equal to the width $W_4$ of the short side 60*a* of the head plate 60.

The respective heads 11*k*-1, 11*c*-1, 11*m*-1 and 11*y*-1 are attached to the respective attachment step portions 62*k*, 62*c*, 62*m* and 62*y*. As a result, a head array consisting of the respective heads 11*k*-1, 11*c*-1, 11*m*-1 and 11*y*-1 is formed. It is to be noted that FIG. 8 shows a state where the head 11*k*-1 is attached to the attachment step portion 62*k* and the head 11*y*-1 is going to be attached to the attachment step portion 62*y*.

Respective positioning protrusions 69*a*, 69*b* and 69*c* are provided at respective corner portions of the head plate 60. The respective positioning protrusions 69*a* and 69*b* are provided to protrude in the Y-axis direction. The respective positioning protrusions 69*a* and 69*b* perform positioning in the Y-axis direction when attaching the head plate to the carriage 27. The positioning protrusion 69*c* is provided to protrude in the X-axis direction. The positioning protrusion 69*c* performs positioning in the X-axis direction when attaching the head plate to the carriage 27.

In case of attaching the respective heads 11*k*-1, 11*c*-1, 11*m*-1 and 11*y*-1 to the respective attachment step portions 62*k*, 62*c*, 62*m* and 62*y* of the head plate 60, respective positions of both end portions of the respective nozzle arrays 47 of the heads 11*k*-1, 11*c*-1, 11*m*-1 and 11*y*-1 in the Y-axis direction substantially match each other. In order to match both end portions of the respective nozzle arrays 47, positions of both end portions of the nozzle arrays 47 are detected by, e.g., a microscope, and the respective heads 11*k*-1, 11*c*-1, 11*m*-1 and 11*y*-1 are subjected to positional adjustment in the Y-axis direction with respect to the head plate 60 based on this detection result. This adjustment is carried out with the respective positioning protrusions 69*a*, 69*b* and 69*c* being determined as references. Consequently, when the respective head plates 60 of the head units 10-1 to 10-3 are attached to the carriage 27, positional adjustment of the respective heads 11*k*-1, 11*c*-1, . . . , 11*y*-3 does not have to be performed.

Rectangular holes 63*k*, 63*c*, 63*m* and 63*y* are formed in the head plate 60. The respective holes 63*k*, 63*c*, 63*m* and 63*y* correspond to the respective positions of the heads 11*k*-1, 11*c*-1, 11*m*-1 and 11*y*-1. A connection substrate 64 is fixed on the upper surface of the head plate 60 by fastening respective screws 65. Respective connectors 66*k*, 66*c*, 66*m* and 66*y* are provided on the lower surface of the connection substrate 64 in accordance with positions of the respective holes 63*k*, 63*c*, 63*m* and 63*y*.

Therefore, in a state where the respective connectors 66*k*, 66*c*, 66*m* and 66*y* are inserted into the respective holes 63*k*, 63*c*, 63*m* and 63*y* of the head plate 60, the connection substrate 64 is attached to the upper surface of the head plate 60. In this state, the heads 11*k*-1, 11*c*-1, 11*m*-1 and 11*y*-1 are respectively attached to the attachment step portions 62*k*, 62*c*, 62*m* and 62*y*. In this case, the respective terminal portions 51*a* of the heads 11*k*-1, 11*c*-1, 11*m*-1 and 11*y*-1 are connected with the connectors 66*k*, 66*c*, 66*m* and 66*y* through the holes 63*k*, 63*c*, 63*m* and 63*y*.

Respective rectangular filter attachment holes 67*k*, 67*c*, 67*m* and 67*y* are provided to the head plate 60. The respective filter attachment holes 67*k*, 67*c*, 67*m* and 67*y* correspond to positions of the respective heads 11*k*-1, 11*c*-1, 11*m*-1 and 11*y*-1. Filters 68*k*, 68*c*, 68*m* and 68*y* are respectively fixedly provided in the filter attachment holes 67*k*, 67*c*, 67*m* and 67*y*. It is to be noted that the drawing shows the respective filters 68*k* and 68*y* alone for the convenience of illustration.

One end of each tube 55 extending from each of the heads 11*k*-1, 11*c*-1, 11*m*-1 and 11*y*-1 is coupled with a lower portion of each of the filters 68*k*, 68*c*, 68*m* and 68*y*. Each of the filters 68*k*, 68*c*, 68*m* and 68*y* removes foreign particles in each ink of the K color, the C color, the M color or the Y color flowing in the tube 55 from each of the bottles 29*k*, 29*c*, 29*m* and 29*y* via each of the sub-tanks 30*k*, 30*c*, 30*m* and 30*y*.

Respective holes 70*a* and 70*b* for attachment are provided at both ends of the head plate 60.

In the head unit 10-1 having the above-described configuration, the width of the short side 60*a* of the head plate 6, i.e., the length $W_4$ of each of the head attachment portions 61*k*, 61*c*, 61*m* and 61*y* is shorter than the length $W_1$ of the nozzle plate 46 of each of the heads 11*k*-1, 11*c*-1, . . . , 11*y*-3 and the length $W_2$ of the nozzle array 47, and satisfies the following expression:

$$W_4 \leqq W_2 - 2 \cdot W_3 \tag{1}$$

Figure 9:
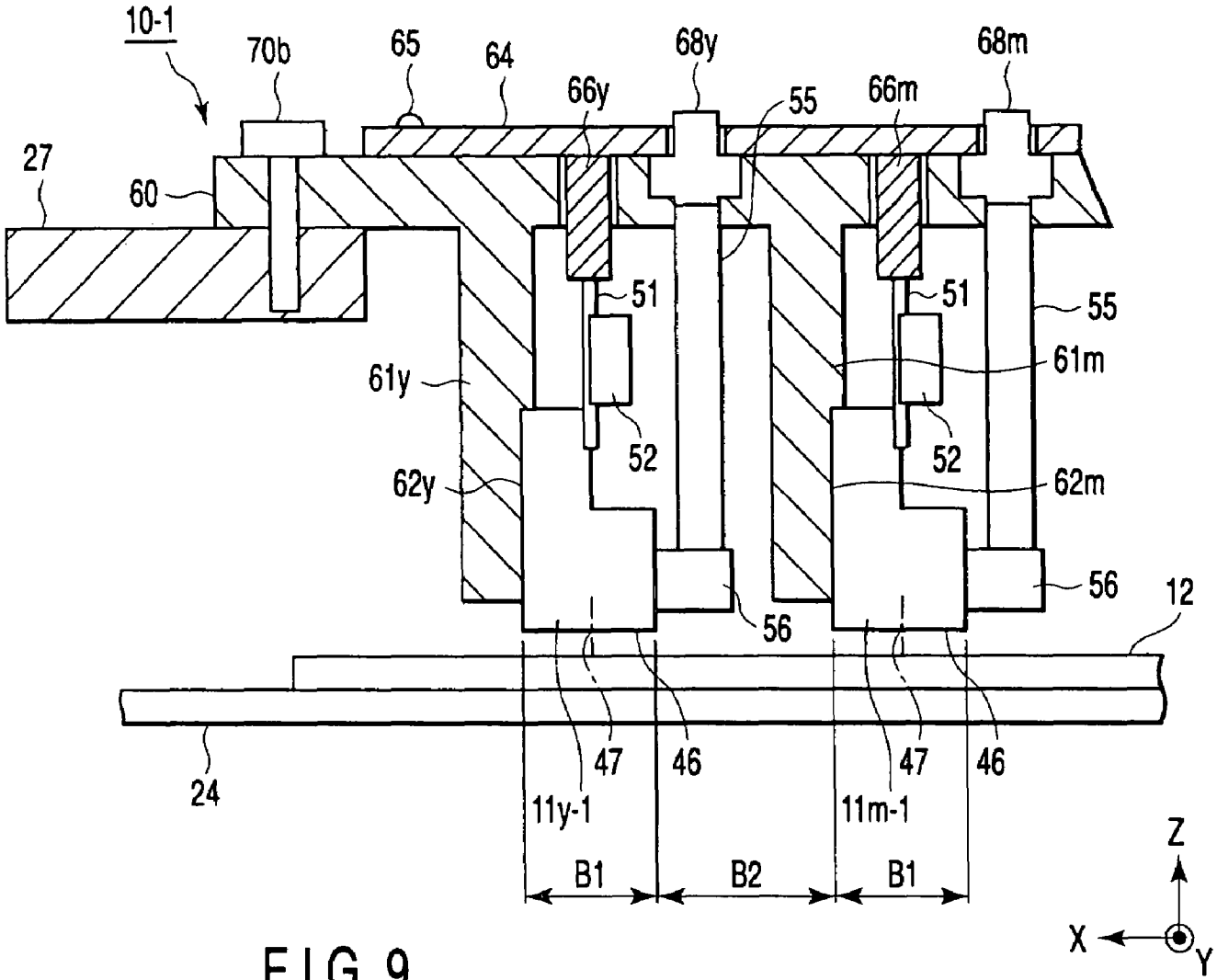
FIG. 9 is a view showing an arrangement interval of the respective heads in the same head unit.

As shown in FIG. 9, each interval $B_2$ between the respective adjacent heads 11*k*-1, 11*c*-1, . . . , 11*y*-3 is set equal to or longer than a thickness $B_1$ of each of the heads 11*k*-1, 11*c*-1, . . . , 11*y*-3 at a peripheral portion of the nozzle plate 46 in the X-axis direction. In this embodiment, the thickness $B_1$ is set to, e.g., 6 mm, and the interval $B_2$ is set to, e.g., 6.5 mm.

Figure 10:
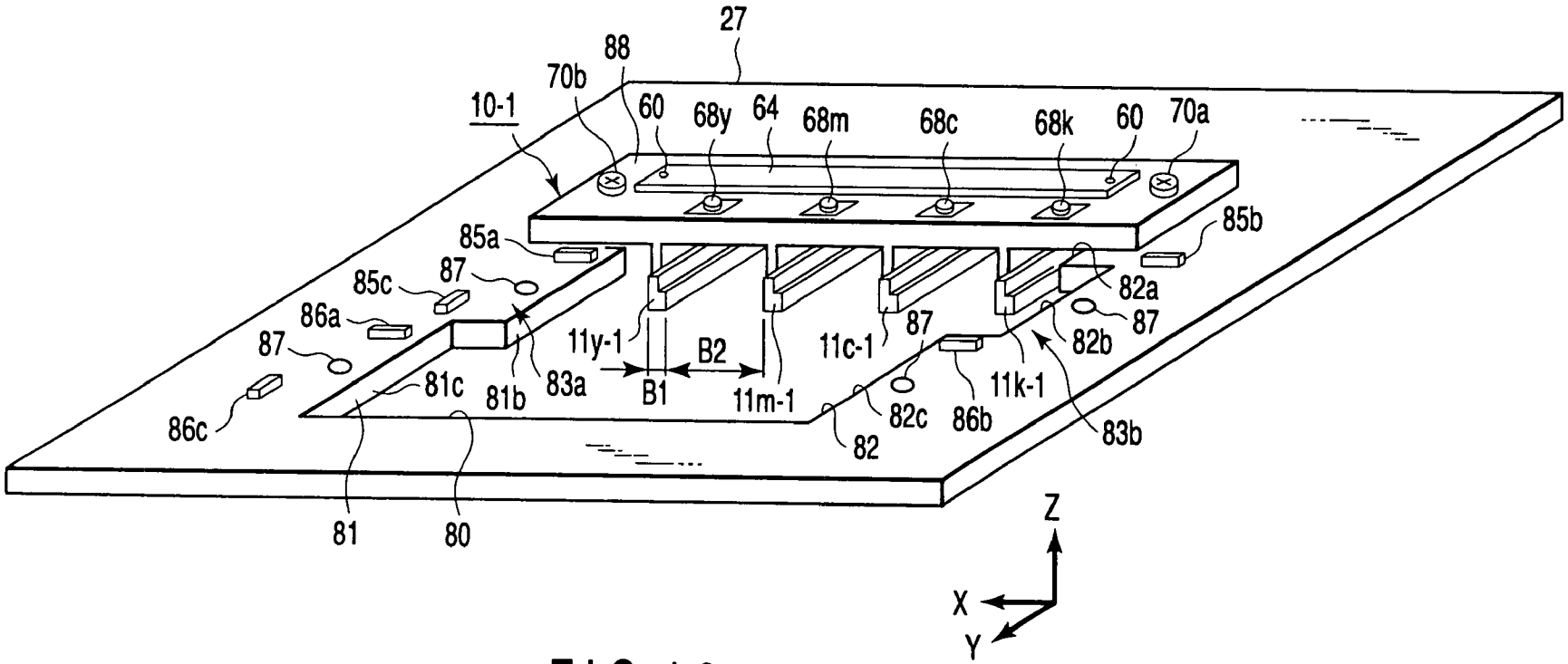
FIG. 10 is a view showing a state in which the head unit is attached to a carriage in the same liquid jet head.

FIG. 10 shows a state where the head unit 10-1 is attached to the carriage 27. The carriage 27 is formed into a rectangular tabular shape. The carriage 27 has an opening portion 80 formed at a central portion. In the opening portion 80, a convex attachment portion 83*a* and a concave attachment portion 83*b* are formed at respective sides 81 and 82 facing each other at the central portion in the X-axis direction. The respective attachment portions 83*a* and 83*b* are formed in order to attach the three head units 10-1 to 10-3 in such a manner that these units are staggered with a predetermined distance in the X-axis direction.

Therefore, the head unit 10-1 is attached between a first side 81*a* and the other first side 82*a* of the respective opposing sides 81 and 82. The head unit 10-2 is attached between a first side 81*b* and the other first side 82*b*. The head unit 10-3 is attached between a first side 81*c* and the other first side 82*c*.

Respective positioning protrusions 84*a*, 84*b*, 84*c*, 85*a*, . . . , 86*c* are provided as respective positioning members on the carriage 27 surface. The respective positioning protrusions 84*a*, 84*b*, 84*c*, 85*a*, . . . , 86*c* position the three head units 10-1 to 10-3 in the X-axis direction and the Y-axis direction. For example, the respective positioning protrusions 84*a*, 84*b* and 84*c* position the head unit 10-1 in the X-axis direction and the Y-axis direction. The respective positioning protrusions 84*a* and 84*b* come into contact with the respective positioning protrusions 69*a* and 69*b* of the head plate 60 to position the head unit 10-1 in the Y-axis direction. The positioning protrusion 84*c* comes into contact with the positioning protrusion 69*c* of the head plate 60 to position the head unit 10-1 in the X-axis direction.

The respective positioning protrusions 85*a*, 85*b* and 85*c* likewise position the head unit 10-2 in the X-axis direction and the Y-axis direction. The respective positioning protrusions 85*a* and 85*b* come into contact with the respective positioning protrusions 69*a* and 69*b* of the head plate 60 of the head unit 10-2 to position the head unit 10-2 in the Y-axis direction. The positioning protrusion 85*c* comes into contact with the positioning protrusion 69*c* of the head plate 60 to position the head unit 10-2 in the X-axis direction.

The respective positioning protrusions 86*a*, 86*b* and 86*c* likewise position the head unit 10-3 in the X-axis direction and the Y-axis direction. The respective positioning protrusions 86*a* and 86*b* come into contact with the respective positioning protrusions 69*a* and 69*b* of the head plate 60 of the head unit 10-3 to position the head unit 10-3 in the Y-axis direction. The positioning protrusion 86*c* comes into contact with the positioning protrusion 69*c* of the head plate 60 to position the head unit 10-3 in the X-axis direction.

Each screw hole 87 is provided on the carriage 27 surface. Each screw hole 87 is provided to respectively attach and fix the three head units 10-1 to 10-3.

The carriage 27 and the head plate 60 are formed by the same aluminum die casting and have the same thermal expansion coefficient. As a result, the carriage 27 and the head plate 60 are prevented from being deformed by the same thermal expansion.

The three head units 10-1 to 10-3 are fixed by fitting each screw 88 in each screw hole 87 on the carriage 27 surface. As a result, the respective head units 10-1 to 10-3 are provided with the longitudinal direction thereof being set along the carriage direction (the X-axis direction) of the recording medium 12.

For example, in case of attaching the head unit 10-1 on the carriage 27 surface, the respective positioning protrusions 69*a* and 69*b* of the head plate 60 are brought into contact with the respective positioning protrusions 84*a* and 84*b* to position the head unit 10-1 in the Y-axis direction, and the positioning protrusion 69*c* is brought into contact with the positioning protrusion 84*c* to position the same in the X-axis direction.

Likewise, the respective positioning protrusions 69*a* and 69*b* of the head plate 60 are brought into contact with the respective positioning protrusions 85*a* and 85*b* to position the head unit 10-2 in the Y-axis direction, and the positioning protrusion 69*c* is brought into contact with the positioning protrusion 85*c* to position the same in the X-axis direction.

The respective positioning protrusions 69*a* and 69*b* of the head plate 60 are brought into contact with the respective positioning protrusions 86*a* and 86*b* to position the head unit 10-3 in the Y-axis direction, the positioning protrusion 69*c* is brought into contact with the positioning protrusion 86*c* to position the head unit 10-3 in the X-axis direction.

Incidentally, in case of attaching the three head units 10-1 to 10-3 on the carriage 27 surface, the position and inclination of the head plate 60 are adjusted with respect to the carriage 27 surface as required.

When the three head units 10-1 to 10-3 are attached on the carriage 27 surface in this manner, the head units 10-1 to 10-3 are provided in parallel with each other on the carriage 27 surface. At this time, the respective head units 10-1 to 10-3 are provided at a predetermined first pitch P1 (a P pitch) in the Y-axis direction.

As a result, in the head unit 10-1, the head 11*k*-1 of the K color, the head 11*c*-1 of the C color, the head 11*m*-1 of the M color and the head 11*y*-1 of the Y color area arranged from the upstream side toward the downstream side in the carriage direction of the recording medium 12. Likewise, in the head unit 10-2, the head 11*k*-2 of the K color, the head 11*c*-2 of the C color, the head 11*m*-2 of the M color, and the head 11*y*-2 of the Y color are arranged from the upstream side toward the downstream side in the carriage direction of the recording medium 12. In the head unit 10-3, the head 11*k*-3 of the K color, the head 11*c*-3 of the C color, the head 11*m*-3 of the M color and the head 11*y*-3 of the Y color are arranged.

The respective heads 11*k*-1, 11*c*-1, . . . , 11*y*-3 in the respective head units 10-1 to 10-3 are arranged along the direction (the Y direction) orthogonal to the carriage direction (the X-axis direction) of the recording medium 12.

Therefore, the respective nozzle arrays 47 in the respective heads 11*k*-1, 11*c*-1, . . . , 11*y*-3 are arranged along the main scanning direction which is the direction (the Y direction) orthogonal to the carriage direction (the X-axis direction) of the recording medium 12.

In case of attaching the respective head units 10-1 to 10-3 to the carriage 27, the head unit 10-2 is attached between the convex attachment portion 83*a* and the concave attachment portion 83*b* as shown in FIG. 10. Gaps between the head unit 10-2 and the adjoining head units 10-1 and 10-3 on the both sides in the X-axis direction are provided to be shifted at predetermined intervals. That is, for example, a gap between the head 11*k*-1 and the head 11*k*-2 is provided to be shifted by a distance corresponding to an interval $(B_1+B_2)/2$ which is ½ of a predetermined second pitch $P_2$ $(=B_1+B_2)$.

As a result, end portions on one side of one head array, e.g., the heads 11*k*-1, 11*c*-2, 11*m*-2 and 11*y*-2 of the head unit 10-2 are inserted and arranged between end portions on the other side of the other head array, e.g., the heads 11*k*-1, 11*c*-1, 11*m*-1 and 11*y*-1 of the head unit 10-1 and in respective spaces 89*a*, 89*b*, 89*c* and 89*d* on the sides of these end portions and/or between these end portions. For example, one end portion of the head 11*y*-2 is adjacent to the other end portion of the head 11*y*-1, and inserted and arranged in the space 89*d* between the other end portions of the head 11*y*-1 and the head 11*m*-1.

With such an arrangement of the respective heads 11*k*-1, 11*c*-1, . . . , 11*y*-3 in the respective head units 10-1 to 10-3, the first predetermined pitch P1 between the head units 10-1 to 10-3 is set equal to or shorter than the length $W_2$ of each nozzle array 47 in each of the heads 11*k*-1, 11*c*-1, . . . , 11*y*-1.

As a result, for example, a position of one end portion of each nozzle array 47 in each of the heads 11*k*-1, 11*c*-1, 11*m*-1 and 11*y*-1 in the head unit 10-1 matches with or overlaps a position of the other end portion of each nozzle array 47 in each of the heads 11*k*-2, 11*c*-2, 11*m*-2 and 11*y*-2 in the adjoining head unit 10-2 as seen from the X-axis direction.

Likewise, a position of one end portion of each nozzle array 47 of each of the heads 11*k*-2, 11*c*-2, 11*m*-2 and 11*y*-2 matches with or overlaps a position of the other end portion of each nozzle array 47 of each of the heads 11*k*-3, 11*c*-3, 11*m*-3 and 11*y*-3 between the adjacent head units 10-2 and 10-3 as seen from the X-axis direction.

Figure 2:
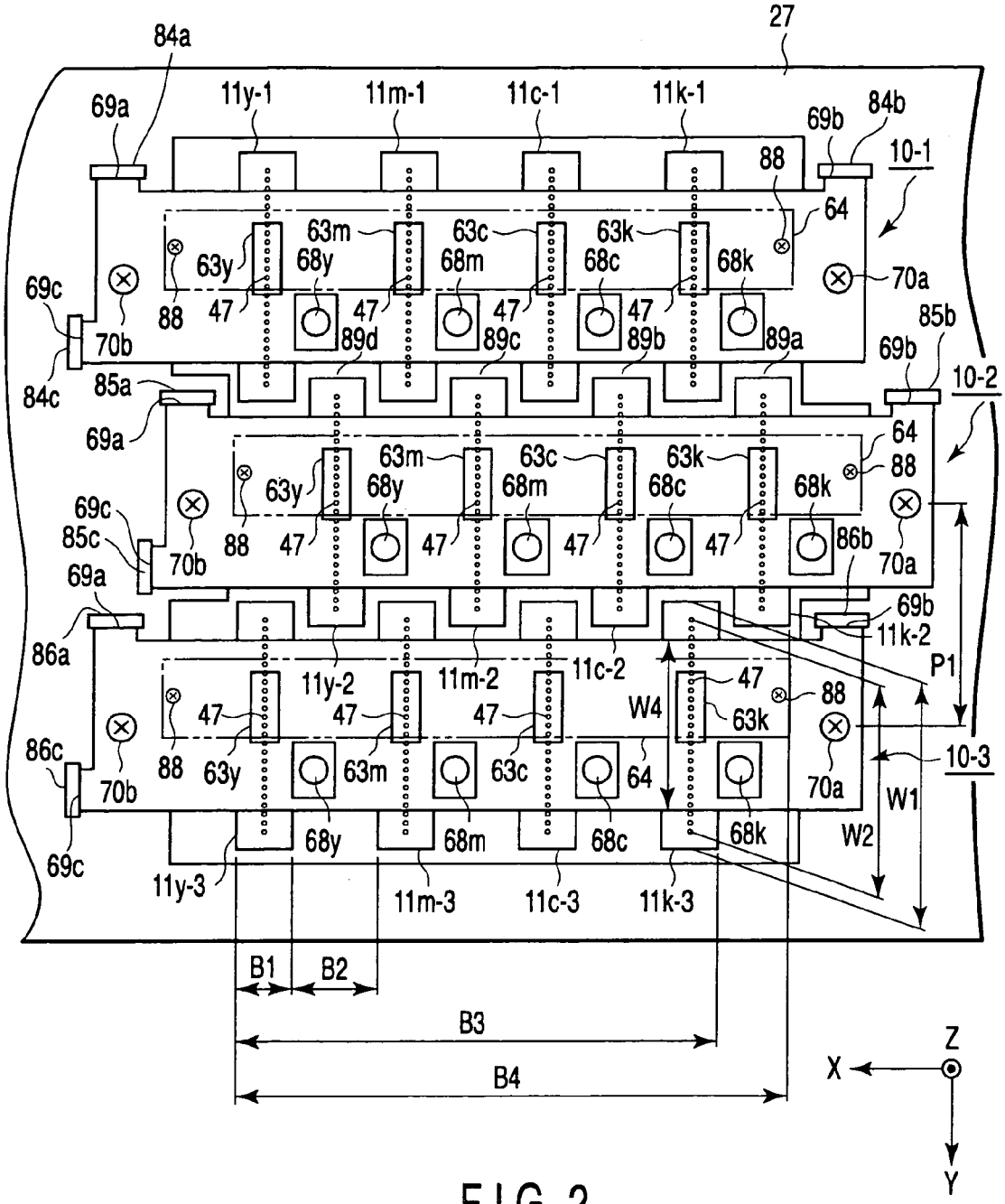
FIG. 2 is a view showing the arrangement of each head in each head unit in the liquid jet head.

Each tube 55 of each of the heads 11*k*-1, 11*c*-1, . . . , 11*y*-3 and each tube fixing member 56 protruding from each of the heads 11*k*-1, 11*c*-1, . . . , 11*y*-3 in the X-axis direction are arranged in each space of an interval $B_2$ between the respective heads 11*k*-1, 11*c*-1, . . . , 11*y*-3 adjacent to each other in the X-axis direction as shown in FIG. 2 and FIG. 9.

As described above, the carriage 27 on which the respective head units 10-1 to 10-3 are mounted is fixed to the frame 13 as shown in FIG. 1.

With the arrangement of the respective heads 11*k*-1, 11*c*-1, . . . , 11*y*-3 mentioned above, even if each interval between the respective heads 11*k*-1, 11*c*-1, . . . , 11*y*-3 arranged on the head plate 60 is as wide as $B_2$, the length $B_4$ of the respective heads 11*k*-1, 11*c*-1, . . . , 11*y*-3 in the entire image forming apparatus shown in FIG. 2 in the X-axis direction can be set to substantially the length in the X-axis direction of the respective eight heads 11*k*-1, 11*c*-1, . . . , 11*y*-3 in which two sets of the four colors KCMY are provided.

A total of the 12 heads 11*k*-1, 11*c*-1, . . . , 11*y*-3 are arranged in such a manner that the respective heads of the same color, e.g., the respective heads 11*k*-1, 11*k*-2 and 11*y*-3 of the K color are staggered along the Y-axis direction. The respective heads are arranged in such a manner that positions of the both end portions of the respective nozzle arrays 47 match with or overlap each other as seen from the X-axis direction. In the respective heads 11*k*-1, 11*c*-1, . . . , 11*y*-3, eject timings of ejecting the respective inks having the colors KCMY can be adjusted by a control portion or the like in accordance with each of the heads 11*k*-1, 11*c*-1, . . . , 11*y*-3.

For example, it is possible to record with four colors, i.e., the K color, the C color, the M color and the Y color within the length $W_2$ of the nozzle array 47 formed in the nozzle plate 60 of one head 11*k*-1 in one head unit 10-1.

As a result of such arrangement of the respective heads 11*k*-1, 11*c*-1, . . . , 11*y*-3, each of the heads 11*k*-1, 11*c*-1, . . . , 11*y*-3 is apparently equal to a head provided with a nozzle array having, e.g., a nozzle pitch of 300 dpi, 3720 nozzles and a string length of 315 mm.

When the eject timings of the respective inks of the K color, the C color, the M color and the Y color from the respective heads 11*k*-1, 11*c*-1, . . . , 11*y*-3 are adjusted, one straight line can be formed on the recording medium 12 in the Y-axis direction which is the main scanning direction.

As shown in FIG. 9, each nozzle plate 46 on which the nozzle array 47 of each of the heads 11*k*-1, 11*c*-1, . . . , 11*y*-3 is formed is arranged to face the belt 24, and also arranged in such a manner that a gap of approximately 1 mm between the nozzle plate 46 and the surface of the belt 24, which is specifically a distance of approximately 1 mm between the nozzle plate 46 and the recording medium 12 sucked and carried by the belt 24 is formed.

An image forming operation by the apparatus having the above-mentioned configuration will now be described.

First, the recording mediums 12 supplied from the recording medium supply base 14 are fed into the apparatus main body frame 13 by the paper feed roller 15. The recording mediums 12 are divided into each piece by the separation roller 15*a*, and then comes into contact with the resist roller pair 17. The resist roller pair 17 adjusts a timing and resupplies the recording medium 12. An end of the recording medium 12 is nipped between the auxiliary roller 22*a* and the belt 24, and the recording medium 12 is carried onto the belt 24 of the belt platen unit 18.

The recording medium 12 mounted on the belt 24 is sucked from the end thereof on the belt 24 by a suction force (a negative pressure) generated by driving of each suction fan 26. That is, the belt platen unit 18 performs suction of air through each suction hole of the belt 24 by driving of each suction fan 26 in the suction chamber 25. As a result, the recording medium 12 is sucked on the belt 24. In this state, the recording medium 12 is carried in the X-axis direction (the sub-scanning direction) by movement of the belt 24 at a predetermined speed. Consequently, the recording medium 12 travels below the respective heads 11*k*-1, 11*c*-1, . . . , 11*y*-3.

As this time, for example, a line sensor (CCD) arranged immediately after the auxiliary roller 22*a* in the carriage direction reads a change in a position of the recording medium 12. The control portion reads a signal from the line sensor, and controls timings of the respective inks having the K color, the C color, the M color and the Y color ejected from each nozzle array 47 of each of the heads 11*k*-1, 11*c*-1, . . . , 11*y*-3. Specifically, the control portion calculates a timing at which the end portion of the recording medium 12 travels below each of the head units 10-1 to 10-3 along the carriage direction, and matches the obtained timing with the eject start timing of each ink having the K color, the C color, the M color or the Y color ejected from each of the heads 11*k*-1, 11*c*-1, . . . , 11*y*-3.

After the recording medium 12 reaches a position below each of the heads 11*k*-1, 11*k*-2 and 11*k*-3 of the K color, the recording medium 12 is then sequentially carried below the respective heads 11*c*-1, 11*c*-2 and 11*c*-3 of the C color, the respective heads 11*m*-1, 11*m*-2 and 11*m*-3 of the M color, and the respective heads 11*y*-1, 11*y*-2 and 11*y*-3 of the Y color.

In the respective heads 11*k*-1, 11*k*-2 and 11*k*-3 of the K color, the respective heads 11*c*-1, 11*c*-2 and 11*c*-3 of the C color, the respective heads 11*m*-1, 11*m*-2 and 11*m*-3 of the M color and the respective heads 11*y*-1, 11*y*-2 and 11*y*-3 of the Y color, the eject start timings of the respective inks having the K color, the C color, the M color and the Y color are achieved. The respective inks of the K color, the C color, the M color and the Y color ejected from the respective heads 11*k*-1, 11*k*-2 and 11*k*-3 of the K color, the respective heads 11*c*-1, 11*c*-2 and 11*c*-3 of the C color, the respective heads 11*m*-1, 11*m*-2 and 11*m*-3 of the M color and the respective heads 11*y*-1, 11*y*-2 and 11*y*-3 of the Y color are spotted onto the surface of the recording medium 12. As a result, an image is formed on the surface of the recording medium 12.

A reference of the ink eject timings is carried out in accordance a pulse signal generated from an encoder provided in the belt platen unit 18. The pulse signal from the encoder is produced in accordance with a movement amount of the belt 24.

On the other hand, the carriage speed of the recording medium 12 is fixed. As a result, color shift of an image formed by the respective colors KCMY can be suppressed to a minimum level. Then, the recording medium 12 having an image formed thereon is ejected by the paper ejection roller pair 19, and accommodated in the paper ejection tray 20.

As described above, according to the first embodiment, between the end portions of the respective heads 11*k*-1, 11*c*-1, 11*m*-1 and 11*y*-1 of, e.g., the head unit 10-1 on one side and in the respective spaces 89*a*, 89*b*, 89*c* and 89*d* on the side of these end portions and/or between these end portions, the end portions of the respective heads 11*k*-2, 11*c*-2, 11*m*-2 and 11*y*-2 of, e.g., the head unit 10-2 on the other side are inserted and arranged. As a result, the entire liquid jet head can be reduced in size. Besides, blurring due to the respective inks of the K color, the C color, the M color and the Y color on the recording medium 12 can be prevented from occurring.

That is, positions of the end portions of the respective nozzle arrays 47 of the heads 11*k*-1, 11*c*-1, 11*m*-1 and 11*y*-1 in, e.g., the head unit 10-1 on one side can match with or overlap positions of the end portions of the respective nozzle arrays 47 of the heads 11*k*-2, 11*c*-2, 11*m*-2 and 11*y*-2 in the adjacent head unit 10-2 on the other side as seen from the X-axis direction. Consequently, the first predetermined pitch P1 between the respective head units 10-1 to 10-3 can be set equal to the length $W_2$ of each nozzle array 47 in the respective heads 11*k*-1, 11*c*-1, . . . , 11*y*-3 or shorter than the length $W_2$ of the nozzle array. As a result, the dimension of the entire head in the X-axis direction can be reduced.

The respective inkjet heads 11*k*-1, 11*c*-1, . . . , 11*y*-3 of the four colors (KCMY) suitable for full-color printing are provided on the head plate 60 at the second intervals $B_2$ in the X-axis direction which is the carriage direction of the recording medium 12. Consequently, it is possible to increase each interval between eject times of the respective inks having the K color, the C color, the M color and the Y color ejected from the four heads, e.g., the heads 11*k*-1, 11*c*-1, 11*m*-1 and 11*y*-1 in the head unit 10-1 onto the same position of the recording medium 12.

As a result, it is possible to increase a time from spotting of the preceding ink onto the recording medium 12 to spotting of the next ink onto the recording medium 12. Consequently, the spotted ink soaks into or becomes dry on the recording medium 12, then the next ink is spotted onto the recording medium 12. Such spotting timings of the inks can avoid blurring of the inks.

The tube 55, the tube fixing member 56 and the respective head attachment portions 61*k*, 61*c*, 61*m* and 61*y* are arranged in the interval $B_2$ which include the respective spaces 89*a*, 89*b*, 89*c* and 89*d* of the respective heads 11*k*-1, 11*c*-1, . . . , 11*y*-2 of the respective head units 10-1 and 10-2, for example. As a result, even if the respective plate ends 46*a* and 46*b* at which the nozzle array 47 is not provided are formed at the both end portions of the nozzle plate 46, the respective heads 11*k*-1, 11*c*-1, . . . , 11*y*-3 of the head unit 10-1 do not interfere with the respective heads 11*k*-1, 11*c*-1, . . . , 11*y*-3 of the adjoining head unit 10-2, for example. As a result, a dimension for arranging the respective heads 11*k*-1, 11*c*-1, . . . , 11*y*-3 in the X-axis direction can be reduced.

The respective heads 11*k*-1, 11*c*-1, . . . , 11*y*-3 are fixed at the respective head attachment portions 61*k*, 61*c*, 61*m* and 61*y* of the head plate 60 formed by head aluminum die casting. As a result, heat generated in the respective heads 11*k*-1, 11*c*-1, . . . , 11*y*-3 can be transmitted to the head plate 60 and the carriage 27 through the respective head attachment portions 61*k*, 61*c*, 61*m* and 61*y* to be effectively released. The respective head attachment portions 61*k*, 61*c*, 61*m* and 61*y* can serve as cooling members.

The respective heads 11*k*-1, 11*c*-1, . . . , 11*y*-3 of the K color, the C color, the M color and the Y color are fixed to the head plate 60 to be formed into a unit (the head units 10-1 to 10-3). Consequently, changing the number of the head units 10-1 to 10-3 to be attached can cope with various kinds of recording widths. For example, in this embodiment, the length $W_2$ of the nozzle array 47 of the one head (e.g., the head 11*k*-1) is set to, e.g., 105 mm, and the three head units 10-1 to 10-3 are used. As a result, the recording width can be set to 315 mm. Therefore, when, e.g., a cut sheet is used as the recording medium 12, recording can be effected on the recording medium 12 without moving the respective heads 11*k*-1, 11*c*-1, . . . , 11*y*-3 in the main scanning directions (the Y-axis direction).

When two head units are used, the recording width becomes 210 mm. As a result, recording can be performed on the recording medium 12 of up to an A4 size. When one head unit is used, a printing width becomes 105 mm. Therefore, recording can be carried out on the recording medium 12 of, e.g., an A6 size such as a postcard. When four or more head units are used, a wider recording range can be realized.

In this manner, when the respective head units 10-1 to 10-3 or the like having the same configuration are used, just changing the number of these units to be arranged in the widthwise direction of the recording medium 12 can cope with various kinds of recording widths. As a result, it is possible to inexpensively facilitate production of the image forming apparatus such as a printer using various kinds of liquid jet units.

A second embodiment according to the present invention will now be described with reference to the accompanying drawings. It is to be noted that the same reference numeral denote parts equal to those in FIG. 7, thereby eliminating their detailed explanation.

Figure 11:
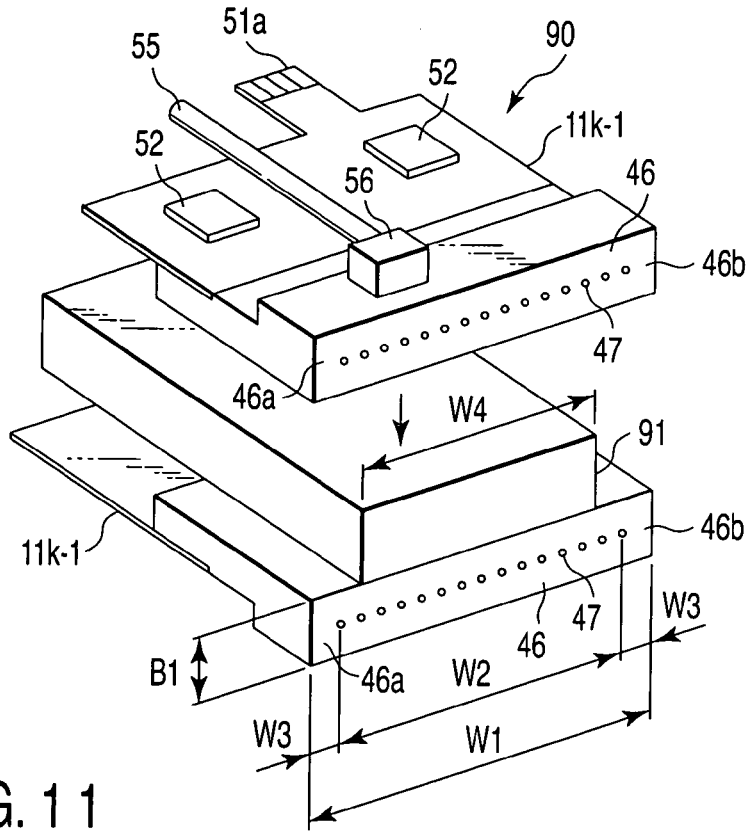
FIG. 11 is a block diagram showing a head unit which is a second embodiment using the liquid jet unit according to the present invention.

FIG. 11 is a block diagram showing a head unit used in an image forming apparatus. In a head unit 90, for example, the two heads 11*k*-1 of the respective heads 11*k*-1, 11*c*-1, . . . , 11*y*-3 in the first embodiment face each other through a plate 91.

For example, a nozzle array 47 in the head 11*k*-1 has, e.g., 300 dpi. In case of opposing the two heads 11*k*-1 to each other, positions of the respective nozzle arrays 47 are shifted with, e.g., a half pitch. As a result, the head unit 90 has 600 dpi which is two times as high as 300 dpi of one nozzle array 47.

Figure 12:
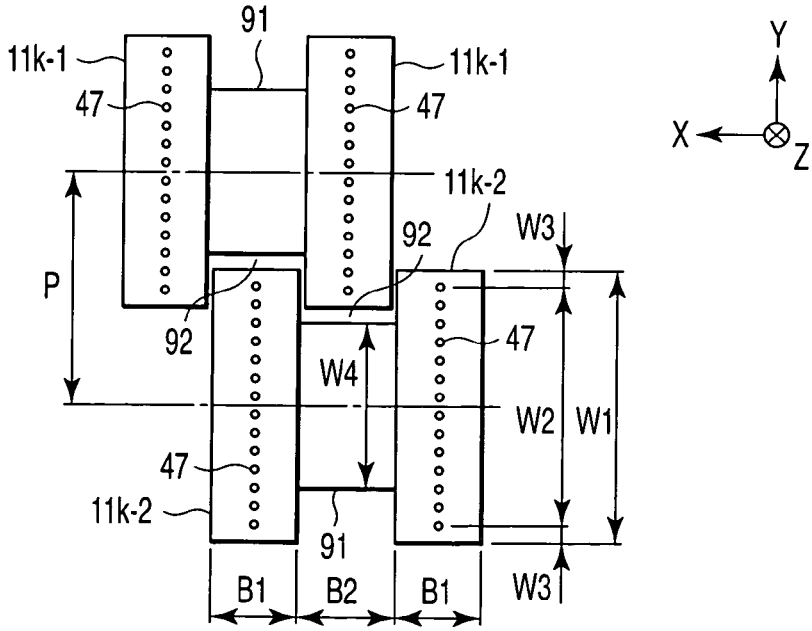
FIG. 12 is a view showing the arrangement when the same head unit is attached to an image forming apparatus.

The plurality of head units 90 are attached to the carriage 27 in the image forming apparatus. For example, as shown in FIG. 12, the end portions of one head array, e.g., the respective heads 11*k*-2 of the head unit 90-2 on one side are inserted and arranged in the respective spaces 92 between the end portions of the other head array, e.g., the respective heads 11*k*-2 of the head unit 90-1 on the other side.

In such a configuration, a length $W_4$ of the plate 91 in the direction of the nozzle array 47 is set to the following expression:

$$W_4 \leqq W_2 - 2 \cdot W_3 \tag{2}$$

A thickness $B_1$ of the peripheral portion of the nozzle plate 46 in the X-axis direction and an interval (an interval between the respective heads 11*k*-2) $B_2$ of the adjacent heads 11*k*-2 are set to the following expression:

$$B_2 \geqq B_1 \tag{3}$$

As a result, a gap between each head 11*k*-1 and each head 11*k*-2 adjacent to each other as seen from the X-axis direction of each nozzle array 47 can be set to zero, or these heads can partially overlap each other.

One end portion of each head 11*k*-1 is inserted and arranged in the space 92 between the respective heads 11*k*-2 adjacent to each other. Consequently, like the first embodiment, the entire liquid jet head can be reduced in size. Blurring due to the respective inks having the K color, the C color, the M color and the Y color on the recording medium 12 can be prevented from occurring.

A third embodiment according to the present invention will now be described hereinafter with reference to the accompanying drawings. It is to be noted that like reference numerals denote parts equal to those in FIG. 8, thereby eliminating their detailed explanation.

Figure 13:
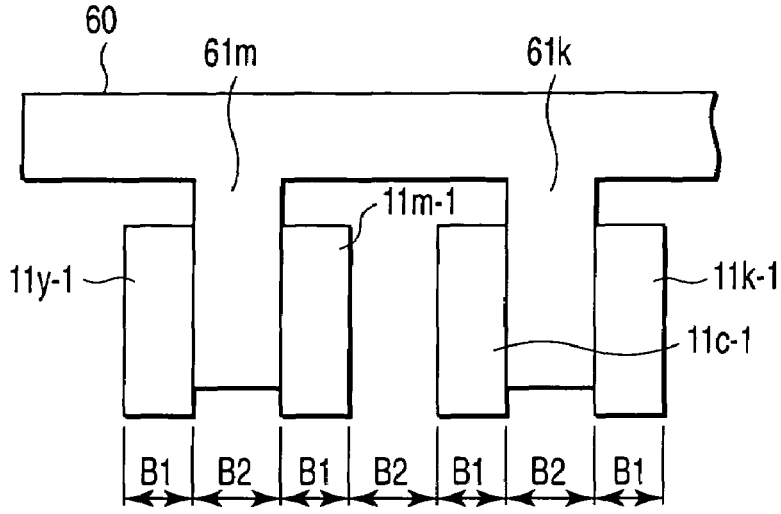
FIG. 13 is a block diagram showing a head unit which is a third embodiment using the liquid jet head according to the present invention.

FIG. 13 is a block diagram showing a head unit for use in an image forming apparatus. The respective heads 11*k*-1, 11*c*-1, . . . , 11*y*-3 in the first embodiment, e.g., two heads 11*k*-1 and 11*c*-1 are provided on both sides of respective head attachment portions 61*k* and 61*m* provided on a head plate 60. A relationship between a thickness $B_1$ of the head 11*k*-1 and an interval $B_2$ between the adjacent heads 11*k*-1 and 11*c*-1 or the adjacent heads 11*c*-1 and 11*m*-1 are set to $B_1 \leqq B_2$.

Figure 14:
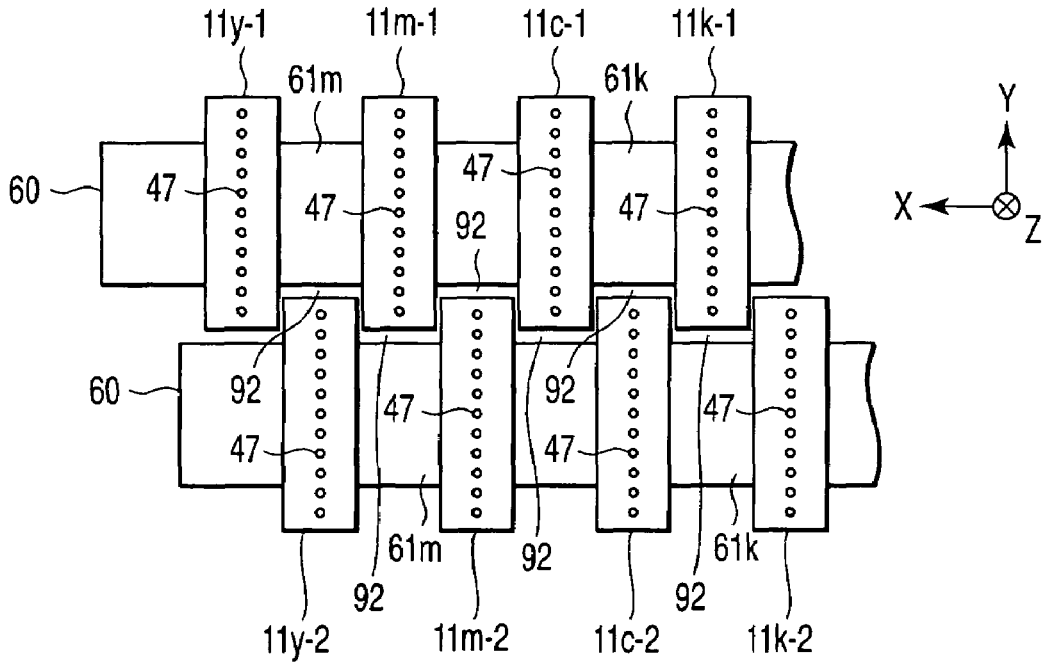
FIG. 14 is a view showing the arrangement of heads in the same head unit.

Consequently, as shown in FIG. 14, as to an arrangement of each head 11*k*-1, one end portion of each head 11*k*-1 is inserted and arranged in a space 92 between the respective heads 11*k*-2 and 11*c*-2 adjacent to each other. Therefore, like the first embodiment, the entire liquid jet head can be reduced in size. It is possible to avoid occurrence of blurring due to the respective inks having the K color, the C color, the M color and the Y color on the recording medium 12.

It is to be noted that the present invention is not restricted thereto, and can be modified as follows.

Although the respective inkjet heads 11*k*-1, 11*c*-1, . . . , 11*y*-3 utilizing the piezoelectric members 40 and 41 are used, the present invention is not restricted thereto. As the inkjet head, it is possible to apply, e.g., any other bubble jet type head unit having each nozzle array in which a plurality of nozzles are arranged.

As the recording medium 12, it is possible to use a cut sheet, a roll sheet and others.

The respective heads 11*k*-1, 11*c*-1, . . . , 11*y*-3 are fixed heads which do not move in the main scanning direction (the Y-axis direction). The present invention is not restricted thereto, and the respective heads 11*k*-1, 11*c*-1, . . . , 11*y*-3 may be moved. For example, the carriage 27 may be rotated 90 degrees around the Z axis to move the carriage 27 in the Y-axis direction, thereby effecting recording.

Although the respective heads 11*k*-1, 11*c*-1, 11*m*-1 and 11*y*-1 of the four colors, i.e., the K color, the C color, the M color and the Y color are provided in one head unit 10-1 or the like, it is possible to adopt a configuration in which two or more heads, e.g., the heads 11*k*-1 and 11*c*-1 or the nozzle array 47 are arranged.

Although the respective heads 11*k*-1, 11*c*-1, 11*m*-1 and 11*y*-1 of the four colors KCMY are provided in one head unit 10-1 or the like, the present invention is not restricted thereto, and each of the heads 11*k*-1, 11*c*-1, 11*m*-1 and 11*y*-1 may be configured to eject an ink of at least one of the K color, the C color, the M color and the Y color.

Figure 15:
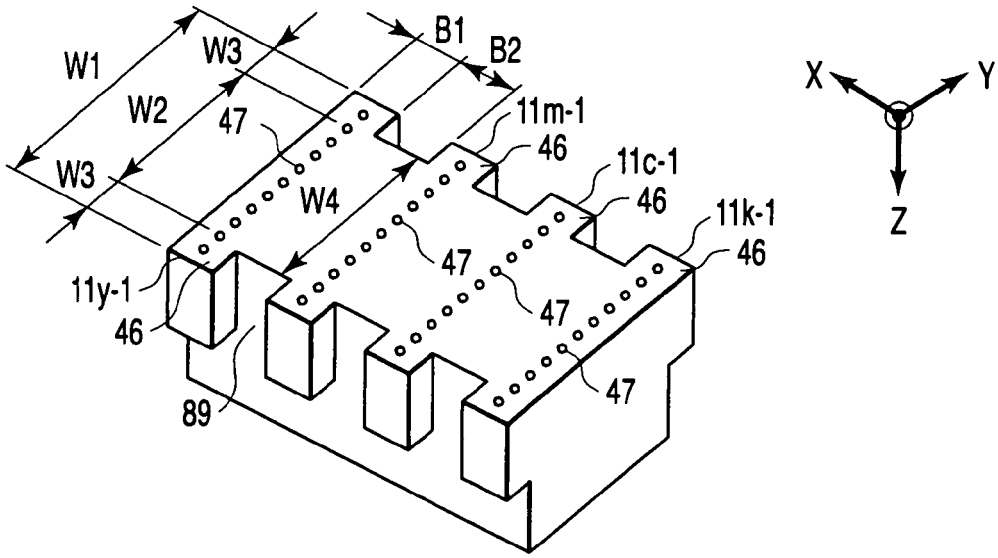
FIG. 15 is a view showing a modification of the same head unit.
Figure 16:
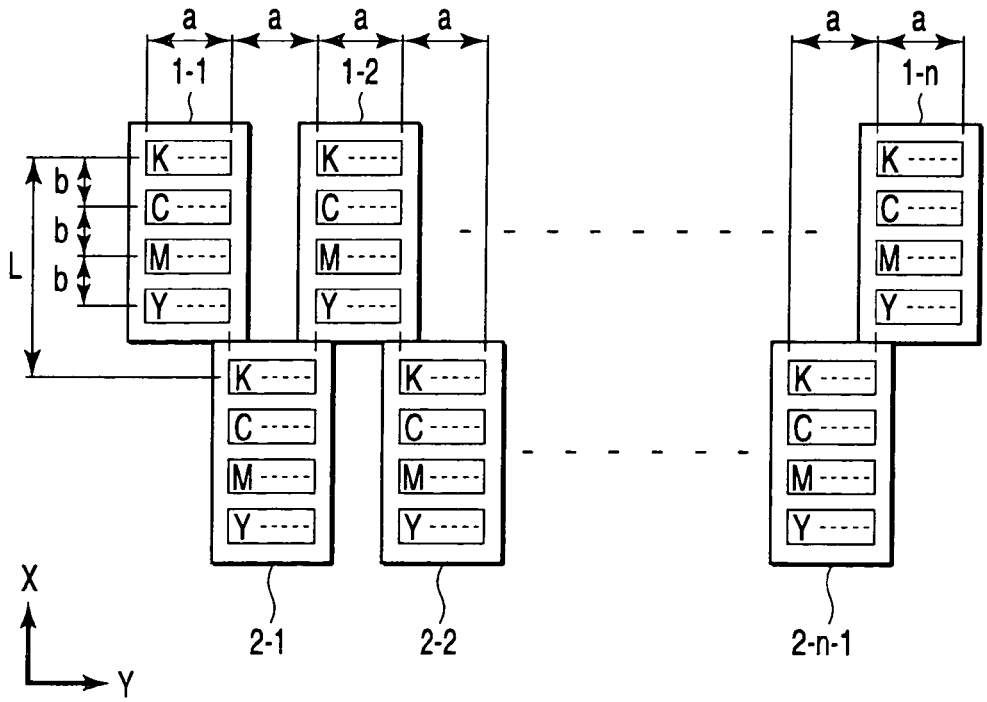
FIG. 16 PRIOR ART
FIG. 16 is a block diagram showing a conventional inkjet printer.
Figure 17:
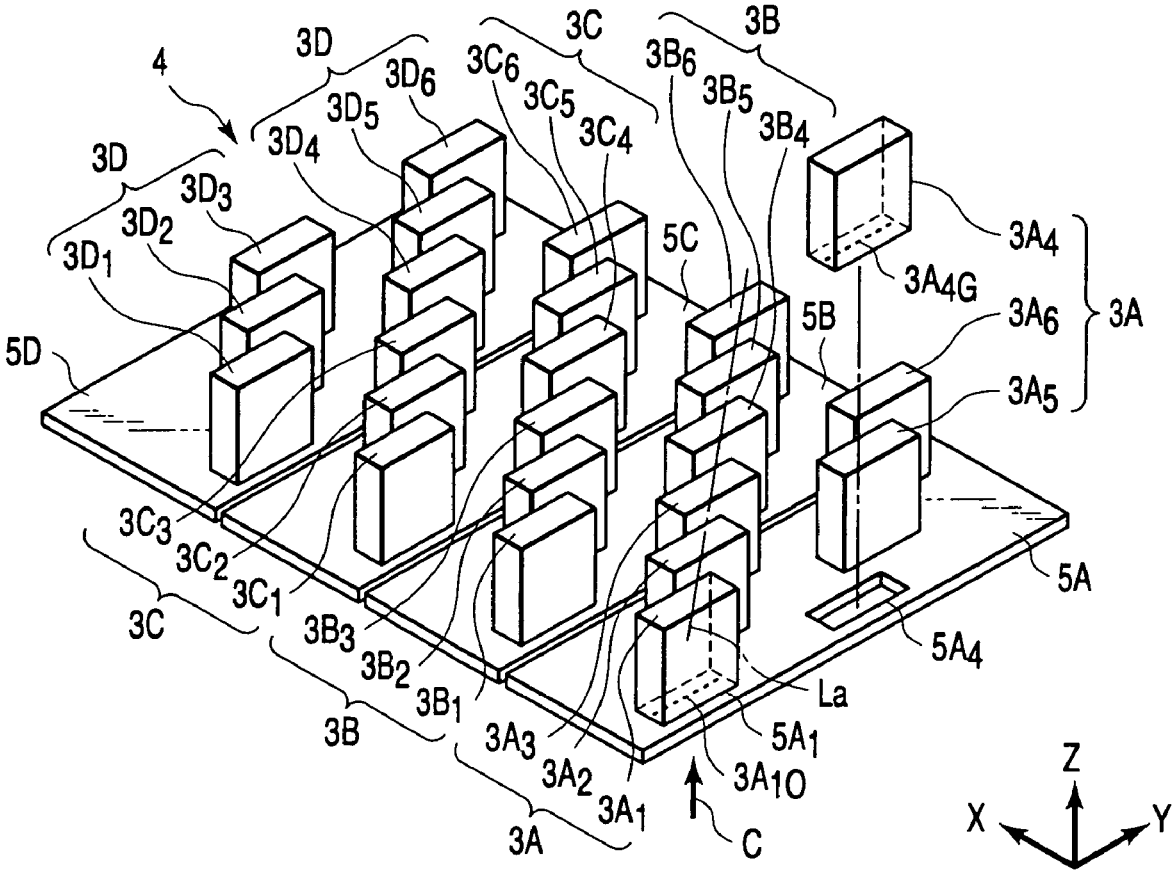
FIG. 17 PRIOR ART
FIG. 17 is a block diagram showing a conventional inkjet printer.

The four heads, e.g., the respective heads 11*k*-1, 11*c*-1, 11*m*-1 and 11*y*-1 are provided on the head plate 60 to constitute one head unit 10-1. The present invention is not restricted thereto, and the head plate 60 and the respective heads 11*k*-1, 11*c*-1, 11*m*-1 and 11*y*-1 may be integrally formed as shown in FIG. 15. In this case, if at least two nozzle arrays 47 are provided and each space 89 is formed between end portions of the respective nozzle arrays 47 in the nozzle array direction, the entire liquid jet head can be reduced in size, and blurring due to the inks of the respective colors on the recording medium 12 can be avoided like the first embodiment.

The present invention is not restricted to the inkjet printer, and the present invention can be applied to a liquid jet head which is used for ejecting a small amount of liquid droplets in a printer such as a copying machine or a facsimile machine which ejects liquid droplets with respect to the recording medium 12 to perform recording, a micro-eject apparatus for an adhesive, a manufacturing apparatus of a color filter in an LCD and others.

What is claimed is:

1. A liquid jet head comprising:

at least two independent head units each having a plurality of heads, wherein each of the heads comprises a linear array of nozzles which are arrancied in a first direction and which eject at least liquid droplets, in each of the at least two head units, the plurality of heads are arranged in parallel at a second pitch along a second direction substantially orthogonal to the first direction, the at least two head units are arranged in parallel at a first pitch along the first direction, and end portions on a first side of the heads in one of the head units are inserted and arranged in respective spaces between end portions on a second side of the heads in an adjacent one of the head units;

each of the head units comprises a holding member having a plurality of head attachment portions provided at the second pitch, and the plurality of heads of each of the head units are attached to the head attachment portions; and a width of each of the plurality of head attachment portions along the first direction is formed shorter than a length of the linear array of nozzles of each of the plurality of heads.

2. A liquid jet head comprising:

a plurality of independent head units each of which has a plurality of heads attached to a holding member, wherein each of the plurality of heads comprises: (i) a linear array of nozzles which are arranged in a first direction and which eject at least liquid droplets, and (ii) a nozzle plate on which the linear array of nozzles is provided and having nozzle free plate end portions on which the linear array of nozzles is not provided; and a unit attachment member having a head unit attachment portion which attaches the plurality of head units at a first pitch along the first direction, wherein the holding member has a plurality of head attachment portions to which the plurality of heads are attached at a second pitch along a second direction substantially orthogonal to the first direction, and a size of the plurality of head attachment portions along the first direction is smaller than a size of the nozzle plates along the first direction, wherein the plurality of head units are spaced apart from each other in the first direction and positioned such that a position of an end portion on a first side of the linear array of nozzles in one of the head units is matched with a position of an end portion on a second side of the linear array of nozzles in an adjacent one of the head units so as to overlap each other as seen from the second direction, or such that the end portion on the first side of the linear array of nozzles in said one of the head units overlaps the end portion on the second side of the linear array of nozzles in said adjacent one of the head units as seen from the second direction.

3. The liquid jet head according to claim 2, wherein the holding member and the unit attachment member have a same thermal expansion coefficient.

4. The liquid jet head according to claim 2, wherein the liquid droplets include an ink of a black color, an ink of a cyan color, an ink of a magenta color, an ink of a yellow color, and the respective heads in each of the head units eject the ink of the black color, the ink of the cyan color, the ink of the magenta color and the ink of the yellow color.

5. The liquid jet head according to claim 2, further comprising a plurality of liquid supply paths through which liquids are supplied to the respective heads, and wherein the plurality of liquid supply paths are provided in respective spaces formed between the respective heads.

6. The liquid jet head according to claim 2, wherein the plurality of head attachment portions transmit heat generated in the plurality of heads from the holding member to the unit attachment member to release the heat.

7. The liquid jet head according to claim 2, wherein a widthwise length $W_4$ of the plurality of head attachment portions in the holding member satisfies:

$$W_4 \leqq W_2 - 2 \cdot W_3$$

where $W_2$ is a length along which the linear array of nozzles is provided in the nozzle plate, and $W_3$ is a length of the plate end portions.

8. The liquid jet head according to claim 2, wherein the liquid jet head satisfies:

$$B_2 \geqq B_1$$

where $B_1$ is a thickness of each of the heads in the second direction, and $B_2$ is an interval between the heads in the second direction.

9. The liquid jet head according to claim 2, wherein the liquid jet head satisfies:

$$W_4 \leqq W_2 - 2 \cdot W_3 \text{ and } B_2 \geqq B_1$$

where $W_2$ is a length along which the linear array of nozzles is provided in the nozzle plate, $W_3$ is a length of the plate end portions, $W_4$ is a width of the plurality of head attachment portions in the holding member, $B_1$ is a thickness of each of the heads in the second direction, and $B_2$ is an interval between the heads in the second direction.

10. The liquid jet head according to claim 2, further comprising a substrate which performs electrical connection with respect to the plurality of heads, and wherein the substrate is provided on the holding member.

11. A liquid jet head comprising:

a plurality of head units each of which has a plurality of heads attached to a holding member, wherein each of the plurality of heads comprises: (i) a linear array of nozzles which are arranged in a first direction and which eject at least liquid droplets, and (ii) a nozzle plate on which the linear array of nozzles is provided and having nozzle free plate end portions on which the linear array of nozzles is not provided; and a unit attachment member having a head unit attachment portion which attaches the plurality of head units at a first pitch along the first direction, wherein the holding member has a plurality of head attachment portions to which the plurality of heads are attached at a second pitch along a second direction substantially orthogonal to the first direction, wherein the plurality of head units are spaced apart from each other in the first direction and positioned such that a position of an end portion on a first side of the linear array of nozzles in one of the head units is matched with a position of an end portion on a second side of the linear array of nozzles in an adjacent one of the head units so as to overlap each other as seen from the second direction, or such that the end portion on the first side of the linear array of nozzles in said one of the head units overlaps the end portion on the second side of the linear array of nozzles in said adjacent one of the head units as seen from the second direction, wherein the holding member and the unit attachment member have a same thermal expansion coefficient.

12. A liquid jet head comprising:

a plurality of head units each of which has a plurality of heads attached to a holding member, wherein each of the plurality of heads comprises: (i) a linear array of nozzles which are arranged in a first direction and which eject at least liquid droplets, and (ii) a nozzle plate on which the linear array of nozzles is provided and having nozzle free plate end portions on which the linear array of nozzles is not provided; and a unit attachment member having a head unit attachment portion which attaches the plurality of head units at a first pitch along the first direction, wherein the holding member has a plurality of head attachment portions to which the plurality of heads are attached at a second pitch along a second direction substantially orthogonal to the first direction, wherein the plurality of head units are spaced apart from each other in the first direction and positioned such that a position of an end portion on a first side of the linear array of nozzles in one of the head units is matched with a position of an end portion on a second side of the linear array of nozzles in an adjacent one of the head units so as to overlap each other as seen from the second direction, or such that the end portion on the first side of the linear array of nozzles in said one of the head units overlaps the end portion on the second side of the linear array of nozzles in said adjacent one of the head units as seen from the second direction, wherein a widthwise length $W_4$ of the plurality of head attachment portions in the holding member satisfies:

$$W_4 \leqq W_2 - 2 \cdot W_3$$

where $W_2$ is a length along which the linear array of nozzles is provided in the nozzle plate, and $W_3$ is a length of the plate end portions.

13. The liquid jet head according to claim 12, wherein the liquid jet head satisfies:

$$B_2 \geqq B_1$$

where $B_1$ is a thickness of each of the heads in the second direction, and $B_2$ is an interval between the heads in the second direction.

* * * * *